US011891943B2

(12) United States Patent
Benevelli et al.

(10) Patent No.: US 11,891,943 B2
(45) Date of Patent: Feb. 6, 2024

(54) METHOD FOR CONTROLLING THE PITCH ANGLE OF BLADES OF AN ENGINE COOLING FAN

(71) Applicant: CNH Industrial America LLC, New Holland, PA (US)

(72) Inventors: Alessandro Benevelli, Albinea Reggio Nell'Emilia (IT); Marco Lorenzelli, Scandiano (IT)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 17/773,124

(22) PCT Filed: Oct. 28, 2020

(86) PCT No.: PCT/EP2020/080326
§ 371 (c)(1),
(2) Date: Apr. 29, 2022

(87) PCT Pub. No.: WO2021/083979
PCT Pub. Date: May 6, 2021

(65) Prior Publication Data

US 2022/0364493 A1 Nov. 17, 2022

(30) Foreign Application Priority Data

Oct. 29, 2019 (IT) ..... 102019000019944

(51) Int. Cl.
*F01P 7/06* (2006.01)
*F01P 3/18* (2006.01)
*F04D 29/36* (2006.01)

(52) U.S. Cl.
CPC ..... *F01P 7/06* (2013.01); *F01P 3/18* (2013.01); *F04D 29/36* (2013.01)

(58) Field of Classification Search
CPC ..... F01P 7/06; F01P 3/18; F02D 29/36
(Continued)

(56) References Cited

U.S. PATENT DOCUMENTS 2,880,809 A 4/1959 Wagner
3,373,930 A 3/1968 Rom
(Continued)

FOREIGN PATENT DOCUMENTS

CN 85202986 U 9/1986
DE 4438995 A1 8/1995
(Continued)

OTHER PUBLICATIONS

International Search Report and Written Opinion for PCT Application No. PCT/EP2020/080326 dated Dec. 20, 2020 (11 pages).
(Continued)

*Primary Examiner* — Mahmoud Gimie
(74) *Attorney, Agent, or Firm* — Rickard K. DeMille; Rebecca L. Henkel

(57) ABSTRACT

A method for controlling a pitch angle of blades of a cooling fan of associated with a radiator of an engine, the blades extending radially from a central hub, the fan having an axis. The method includes regulating a pitch angle of the blades from a first limit value for which a cooling flux of the cooling fan has a first value to a second limit value for which the cooling flux has a second value greater than the first value. The pitch angle is determined based on quantities measured in the engine. The method further includes steps of detecting an engine speed; calculating a first derivative of the engine speed to detect accelerations of the engine; comparing the calculated first derivative with a threshold value and if the calculated first derivative is greater than the threshold value, setting the pitch angle to the first minimum limit value.

8 Claims, 2 Drawing Sheets

(58) Field of Classification Search
USPC ..... 123/41.12
See application file for complete search history.

(56) References Cited

U.S. PATENT DOCUMENTS

| | | | | |
|---|---|---|---|---|
| 4,222,353 | A | 9/1980 | Abe et al. | |
| 4,469,053 | A * | 9/1984 | Sakurai | F01P 7/08 123/41.12 |
| 6,113,351 | A | 9/2000 | McCallum et al. | |
| 6,439,850 | B1 | 8/2002 | McCallum et al. | |
| 2005/0016472 | A1* | 1/2005 | Surnilla | F01P 7/048 123/41.02 |
| 2009/0057043 | A1 | 3/2009 | Robinson | |

FOREIGN PATENT DOCUMENTS

| | | | |
|---|---|---|---|
| FR | 942363 | A | 2/1949 |
| JP | 58211598 | A | 12/1983 |
| JP | 63080011 | A | 4/1988 |
| JP | 2005146878 | A | 6/2005 |
| JP | 2006336602 | A | 12/2006 |
| KR | 960001430 | A | 1/1996 |
| WO | 0104496 | A1 | 1/2001 |

OTHER PUBLICATIONS

Italian Search Report for IT Application No. 102019000019944 dated May 25, 2020 (8 pages).
Horton, "Off-Highway," https://web.archive.org/web/20190718073200/https://www.hortonww.com/off-highway.html, archive dated Jul. 18, 2019.

* cited by examiner

METHOD FOR CONTROLLING THE PITCH ANGLE OF BLADES OF AN ENGINE COOLING FAN

TECHNICAL FIELD

The present invention relates to a method for controlling the pitch angle of blades of an engine cooling fan.

BACKGROUND OF THE INVENTION

As is known, liquid cooled engines are provided with a heat exchanger (radiator) that is coupled with a cooling fan that is moved by the vehicle engine.

More specifically, it is also known to electrically control the pitch angle that the blades of a cooling fan form with respect to a plane perpendicular to the fan's axis to regulate the quantity of air that is supplied by the fan to the radiator.

This application is particularly used for cooling big industrial radiators and finds less application in automotive industry.

In those application the pitch angle may be regulated from a first limit value for which the cooling flux is minimum and a second limit value for which the cooling flux is maximum.

Typically the pitch angle may be regulated based on the rpm of the engine or the cooling water temperature. For instance:

U.S. Pat. Nos. 6,439,850 and 6,113,351 describe to control pitch as function of rpm by means of an actuating system;

JP58211598 describes to control mechanically the pitch angle as function of rpm;

KR960001430 describes to control the pitch angle as function of cooling water temperature by means of an actuating system;

DE4438995 describes to control the pitch angle as function of cooling water temperature by means of an actuating system;

CN85202986 describes to control pitch as function of cooling water temperature with a wax actuator; and WO200104496 describes to control the pitch angle as function of rpm and cooling requirement.

Scope of the present invention is to provide a method for controlling the pitch angle of blades of an engine cooling fan in order to reduce fuel consumption.

SUMMARY OF THE INVENTION

The above aim is obtained by the present invention that relates to method for controlling the pitch angle of blades of an engine cooling fan as described in claim 1.

BRIEF DESCRIPTION OF DRAWINGS

For a better understanding of the present invention, a preferred embodiment is described in the following, by way of a non-limiting example, with reference to the attached drawings wherein.

DETAILED DESCRIPTION OF THE INVENTION

Figure 1:
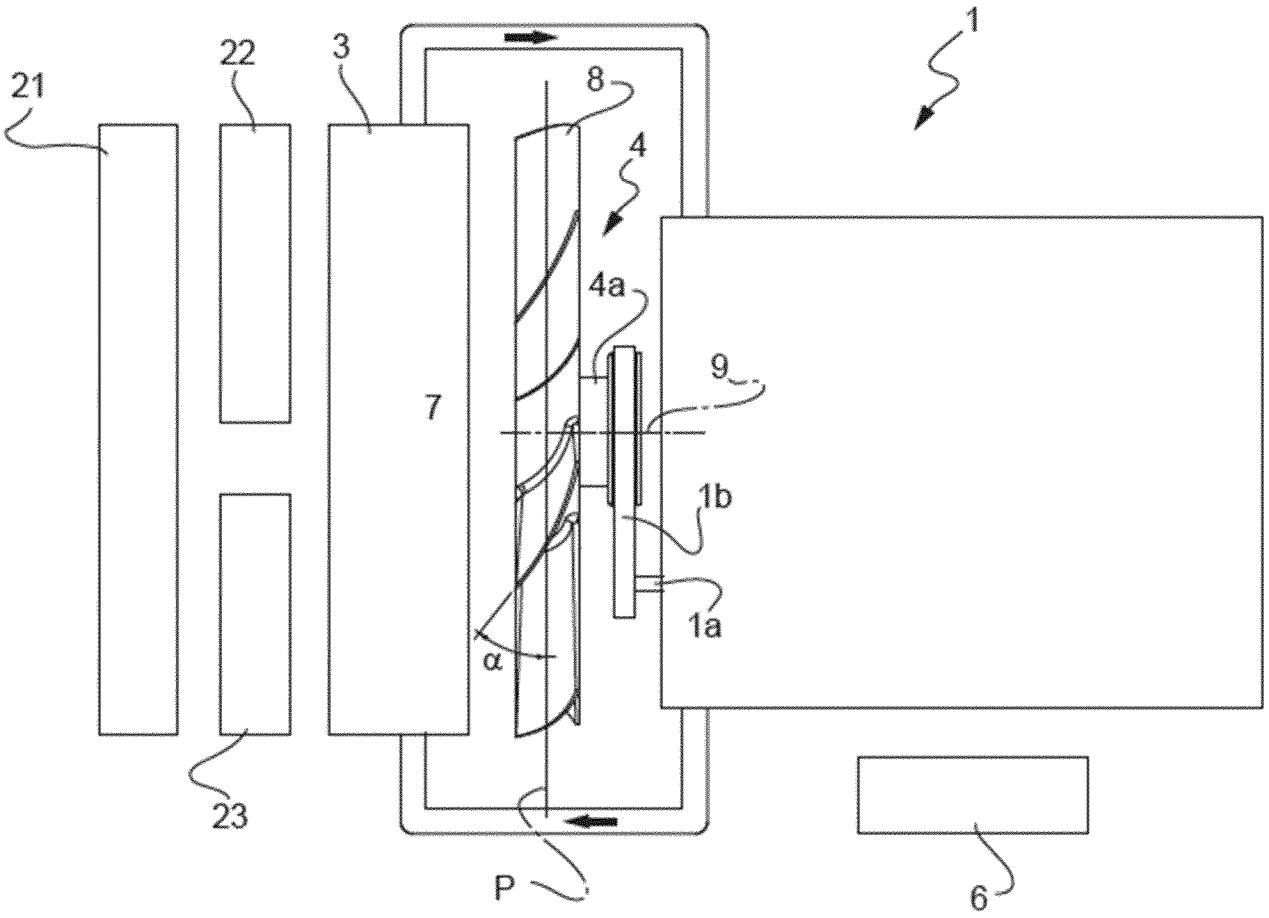
FIG. 1 shows schematically an engine of industrial vehicle working with the method for controlling the pitch angle of blades of an engine cooling fan according to the present invention.

In FIG. 1, numeral 1 indicates an engine of a vehicle (not shown) more specifically an industrial vehicle provided with a radiator 3 forming a part of a liquid cooling system of a known kind.

The radiator 3 is provided with one (or more) cooling fan mechanically powered. Typically, the fan shaft 4*a* is directly connected to the engine pulley 1*a* by a belt 1*b* and is actuated by the engine 1. The fan 4 is controlled by an electronic control unit 6 working under the method of the present invention.

The cooling fan 4 is provided with a central hub 7 and has blades 8 extending radially from the central hub 7. The cooling fan 4 is designed to control (in known manner) the pitch angle α that each blade 8 form with respect to a plane P perpendicular to the fan's axis 9 to regulate the quantity of air that is supplied by the fan 4 to the radiator 3.

The pitch angle is regulated from a first limit value αmin (typically 0 degr.) for which the cooling flux is minimum to a second limit value αMax (typically 45 degr.) for which the cooling flux is maximum, i.e. is greater than in the first case.

The above control may be continuous or in may be performed in discrete steps, or even in just two steps.

A condenser 21 forming a part of an Air conditioning system is placed facing the radiator 3 and an intercooler 22 and a vehicle transmission oil cooler 23 are placed between the radiator 3 and the condenser 21.

Figure 2:
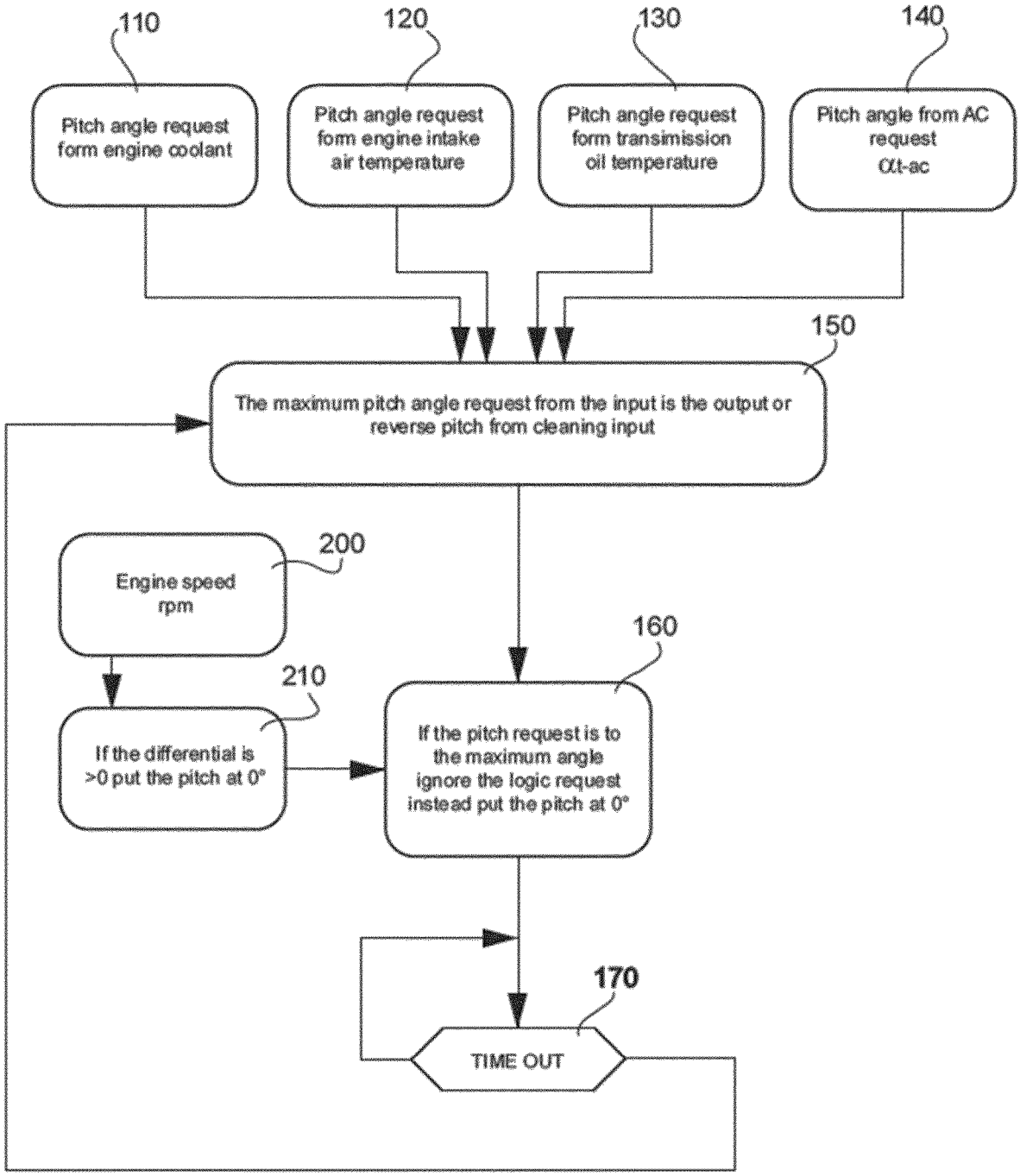
FIG. 2 shows the operations of the method of the present invention.

The control of the pitch angle α according to the to present invention will be described with reference to the flow chart of FIG. 2 that represents the operations performed by the electronic control unit 6.

Block 110 calculates a desired value αt-1 of pitch angle based on the measured temperature Tc of the engine coolant, i.e.:

$$\alpha t\text{-}1=\text{function}(Tc)$$

The relation between quantities is established in a known way by means of a formula or a map.

Block 120 calculates a desired value αt-a of pitch angle based on the measured temperature Ta of the engine intake air, i.e.:

$$\alpha t\text{-}a=\text{function}(Ta)$$

The relation between quantities is established in a known way by means of a formula or a map.

Block 130 calculates a desired value αt-c of pitch angle based on the measured temperature To of the oil of the transmission i.e.:

$$At\text{-}c=\text{function}(To)$$

The relation between quantities is established in a known way by means of a formula or a map.

Block 140 calculates a desired value αt-ac of pitch angle based on the measured Tac value of the trinary pressure switch of an Air Conditioning system.

$$At\text{-}ac=\text{function}(Tac)$$

The relation between quantities is established in a known way by means of a formula or a map As it is known, Trinary Switches provide compressor protection against high side pressures that are too high or too low. In the example, if the refrigerant pressure is over 18barg and the switch of the Air Condition is selected the calculated pitch At-ac is the maximum angle (in the example 45 degr).

Block 150 selects the maximum angle among the angles αt-1, αt-a, At-c e At-ac calculated by blocks 110-140 so that the command to implement in the cooling fan 4 the selected angle may be generated (block 160).

In parallel to the above operations engine speed (rpm) is detected (block 200) and the first derivative of the engine speed is calculated to detect acceleration(s) of the engine. If the calculated derivative is greater than a threshold value (block 210), i.e. the engine is strongly accelerating, the electronic control unit 6 disregards (block 160) the calculated angle of block 150 and sets the angle to the first minimum value αmin so that, during accelerations, the energy drawn by cooling fan is reduced.

This operation concurs in limiting the overall consumption of the engine.

This operation also concurs in reducing noise and avoid overcooling of the engine the could affect efficiency at engine startup.

This operation is continued for a set time (block 170) that may be regulated. At the end of the operation of block 170, if no strong acceleration is sensed anymore, the operations go back to block 150 where the most suitable angle is chosen and implemented.

The invention claimed is:

1. A method for controlling blades of a cooling fan associated with a radiator of an engine, the cooling fan including an axis and a central hub, the blades of the cooling fan extending radially from the central hub, a pitch angle of the blades being adjustable relative to a plane perpendicular to the axis between a minimum pitch angle and a maximum pitch angle at which the cooling fan supplies a greater quantity of air than when the blades are at the minimum pitch angle, the method comprising:

determining one or more engine quantities related to the engine;

determining a selected pitch angle for the blades of the cooling fan based at least in part on the one or more determined engine quantities, the selected pitch angle being greater than the minimum pitch angle;

adjusting the pitch angle of the blades to the selected pitch angle;

determining an engine speed;

determining a first derivative of the engine speed to detect accelerations of the engine; and adjusting the pitch angle of the blades from the selected pitch angle to the minimum pitch angle when the determined first derivative exceeds a threshold value so that, during acceleration, energy drawn by the cooling fan is reduced.

2. The method of claim 1, wherein the minimum pitch angle is adjusted back to the first limit value selected pitch angle when the determined first derivative falls below the threshold value.

3. The method of claim 1, wherein determining the one or more engine quantities comprises determine a plurality of engine quantities related to the engine, and wherein determining the selected pitch angle for the blades of the cooling fan based at least in part on the one or more determined engine quantities comprises determining a plurality of requested pitch angles based on the plurality of engine quantities, each requested pitch angle of the plurality of requested pitch angles being associated with a respective engine quantity of the plurality of engine quantities.

4. The method of claim 3, wherein the plurality of engine quantities comprise at least two of the following:

a measured temperature of the coolant;

a measured temperature of engine intake air;

a measured temperature of transmission oil; or a measured value of a trinary pressure switch of an air conditioning system.

5. The method of claim 1, wherein the minimum pitch angle is 0 degrees.

6. The method of claim 2, wherein the minimum pitch angle is adjusted back to the selected pitch angle when the determined first derivative remains below the threshold value for a selected time period.

7. The method of claim 3, wherein determining the selected pitch angle for the blades of the cooling fan further comprises determining a maximum requested pitch angle of the plurality of requested pitch angles and setting the selected pitch angle as the maximum requested pitch angle.

8. The method of claim 7, wherein adjusting the pitch angle of the blades to the selected pitch angle comprises adjusting the pitch angle of the blades to the maximum requested pitch angle.

* * * * *